US009422035B2

(12) United States Patent
Bauduin et al.

(10) Patent No.: US 9,422,035 B2
(45) Date of Patent: Aug. 23, 2016

(54) DISCONNECTABLE TURRET MOORING SYSTEM

(71) Applicants: Christian Raymond Bauduin, Eze Bord de Mer (FR); Jean-Yves Silvain Toggiani, Roquebrune Cap Martin (FR); Jean Pierre Benoit, Cagnes sur Mer (FR); Jerome Perrin, Biot (FR)

(72) Inventors: Christian Raymond Bauduin, Eze Bord de Mer (FR); Jean-Yves Silvain Toggiani, Roquebrune Cap Martin (FR); Jean Pierre Benoit, Cagnes sur Mer (FR); Jerome Perrin, Biot (FR)

(73) Assignee: SINGLE BUOY MOORINGS INC., Marly (CH)

( * ) Notice: Subject to any disclaimer, the term of this patent is extended or adjusted under 35 U.S.C. 154(b) by 4 days.

(21) Appl. No.: 14/374,694

(22) PCT Filed: Jan. 28, 2013

(86) PCT No.: PCT/EP2013/051548

§ 371 (c)(1),
(2) Date: Jul. 25, 2014

(87) PCT Pub. No.: WO2013/110807

PCT Pub. Date: Aug. 1, 2013

(65) Prior Publication Data

US 2015/0034002 A1 Feb. 5, 2015

(30) Foreign Application Priority Data

Jan. 27, 2012 (EP) ..... 12152828

(51) Int. Cl.
*B63B 21/00* (2006.01)
*B63B 22/02* (2006.01)
*B63B 21/50* (2006.01)

(52) U.S. Cl.
CPC ..... *B63B 21/507* (2013.01); *B63B 21/508* (2013.01); *B63B 22/02* (2013.01); *B63B 22/021* (2013.01); *B63B 22/023* (2013.01)

(58) Field of Classification Search
CPC ..... B63B 21/00; B63B 21/50; B63B 21/507; B63B 21/508; B63B 22/00; B63B 22/02; B63B 22/021; B63B 22/023
USPC ..... 114/230.1, 230.12; 441/3–5
See application file for complete search history.

(56) References Cited

U.S. PATENT DOCUMENTS 5,065,689 A * 11/1991 Krogstad ..... B63B 21/507 114/230.12
5,529,521 A * 6/1996 Breivik ..... B63B 22/026 114/230.1
2007/0202758 A1 8/2007 Olsen et al.
2008/0166936 A1 7/2008 Lindblade

FOREIGN PATENT DOCUMENTS

WO 9311030 A1 6/1993
WO 9311035 A1 6/1993
WO 0189919 A1 11/2001
WO 2007/077126 A1 7/2007
WO 2010081826 A1 7/2010

OTHER PUBLICATIONS

International Search Report, dated Apr. 3, 2013, from corresponding PCT application.

* cited by examiner

*Primary Examiner* — Daniel V Venne
(74) *Attorney, Agent, or Firm* — Young & Thompson

(57) ABSTRACT

Turret mooring system for receiving a mooring buoy, includes a turret mooring structure, and a buoy locking system for locking the mooring buoy, whereby the turret mooring system includes an intermediate connection member, which includes the buoy locking system. The intermediate connection member is rotatably suspended from the turret mooring structure. A method of mooring a vessel, including a turret mooring system, is described whereby the turret mooring system is arranged to receive the mooring buoy. The turret mooring system includes a turret mooring structure that is rotatably suspended from the vessel and an intermediate connection member that is rotatably suspended from the turret mooring structure. The method includes the steps of receiving the mooring buoy into the turret mooring system, locking the mooring buoy to the intermediate connection member, and rotating the intermediate connection member and the turret mooring structure with respect to each other.

21 Claims, 9 Drawing Sheets

DISCONNECTABLE TURRET MOORING SYSTEM

FIELD OF THE INVENTION

The present invention relates to a turret mooring system, a vessel comprising the turret mooring system and a method of mooring the vessel using the turret mooring system.

BACKGROUND OF THE INVENTION

Turret mooring systems are known from the prior art, for instance from WO2007/077126.

Turret mooring systems comprise a mooring buoy and a turret mooring structure. The mooring buoy is anchored to the seabed with anchoring legs. The turret mooring structure, provided on a vessel, has a receptacle for receiving the mooring buoy and one or more buoy locking devices for locking the mooring buoy in the receptacle.

The turret mooring structure may be an internal turret mooring structure or an external turret mooring structure. An internal turret mooring structure is provided inside the hull of the vessel, in a so-called moonpool of the vessel. The receptacle is formed as an opening at or near the bottom of the vessel, facing downwards. An external turret mooring structure is provided outside the hull of the vessel. The external turret is fixed with suitable connection members to the bow or stern of the vessel.

The mooring buoy may be moved up and down, i.e. from a storage position at a safe distance below the water surface (e.g. 30-200 meters) to a mooring position close to or at the surface of the water where it can be received by the receptacle.

The turret mooring structure itself is connected to the vessel, but is rotatable with respect to the vessel, allowing the vessel to weathervane under influence of wind, waves, currents and drifting ice. The turret mooring system may be disconnected and reconnected when needed, thereby providing a disconnectable turret mooring system.

The turret mooring system comprises a fluid transfer system to allow transportation of fluids, for instance by establishing a flow path between the vessel and a subsea well via the turret mooring system and the mooring buoy.

The turret mooring structure may comprise a first part of the fluid transfer system and the mooring buoy may comprise a second part of the fluid transfer system.

The turret mooring structure may comprise a turret manifold and the mooring buoy may comprise a buoy manifold, both manifolds each comprising at least one conduit. The turret and buoy manifold are matching such that conduits of the turret manifold can be connected to corresponding conduits of the buoy manifold of the fluid transfer system to establish a flow path.

During the connection of the mooring buoy to the turret mooring structure, the mooring buoy is locked in a fixed position with respect to the turret mooring structure.

According to state of the art in turret mooring systems, the centering has to be done using the locking of the mooring buoy into the receptacle of the turret mooring structure.

International patent applications WO1993011030-WO1993011035 disclose locking mechanisms of a turret mooring structure comprising a plurality of locking fingers distributed around an annular locking shoulder of the buoy, for releasable locking of the outer member of the mooring buoy in the receiving space. The mechanism comprises a pair of locking dogs which are actuated by a hydraulic system and are rotatable about horizontal axes at diametrically opposite sides of the receiving space. If desired, more than two locking dogs may be provided. The hydraulic actuators for operation of the locking dogs may for example be hydraulic cylinders. When activating the locking dogs these will pivot in a vertical plane to engagement with the downwards facing abutment edge of the upper cone member.

International patent application WO2001089919 discloses a mechanism for releasable locking of an element in relation to a base, especially for the locking of a buoy in a downwardly open receiving space in a floating vessel. The mechanism comprises a rotatably mounted locking arm which is pivotable between a release position and a locking position in which an abutment edge on the locking arm is in engagement with an abutment edge on the element to be locked, a linkage which is connected between the locking arm and the base and which, in the locking position, is in a self-locking over-centre position, and a driving means for actuation of the linkage. The linkage comprises a length-adjustable first link which, from an initial position with the locking arm close to its locking position, is arranged to be extended to thereby pivot the locking arm additionally to a final locking position, for achieving a desired preloading force in the engagement between the abutment edges of the locking arm and the element. The first link preferably is a hydraulic cylinder having a piston rod of which one end is connected to the locking arm.

However, in these systems, designs are not very compact and need a lot of space to be installed, further they do not provide a system that enables to center the buoy. It is therefore an object of the present invention to provide a turret mooring system that overcomes one or more of the disadvantages from the prior art.

SUMMARY OF THE INVENTION

Hereto, a turret mooring system is provided wherein the turret mooring system is arranged for receiving a mooring buoy, the turret mooring system comprising a turret mooring structure, and a buoy locking system for locking the mooring buoy, wherein the buoy locking system comprises at least one locking device, which in a first support frame comprises a locking dog and a further structural element, the first support frame being connected to the turret mooring structure; wherein the further structural element is arranged in the first support frame at a different vertical level than the level of the locking dog and the locking dog is rotatable around a horizontal shaft in the first support frame between an open and a closed position; wherein the further structural element is arranged to engage the surface of the mooring buoy.

Such an embodiment provides the advantage that centering of the mooring buoy and of the fluid transfer system within the buoy can be done during the locking of the mooring buoy into the turret mooring system.

Also, the turret mooring system allows an accurate setting of the concentricity of the turret and the buoy. The locking devices allow proper centering of the mooring buoy with respect to the turret, during the positioning of the top ring of the buoy into the turret. When approaching the locking devices, the top ring of the buoy, lifted-up by the winch, comes into contact vertically with the centering dogs that start rotating thanks to an articulation, and then, achieve the final centering of the buoy by pushing radially on the buoy top ring side. When the centering is completed, the locking dogs are closed and clamp the top ring of the buoy in the turret.

Another advantage is that the number of buoy locking devices can easily be changed, i.e. only requires replacing the intermediate connection member, without the need to adjust the design of the turret mooring structure.

According to an aspect, the present invention relates to a turret mooring system as described above, wherein the further structural element is an upper centering dog positioned above a level of the locking dog, wherein the centering dog is rotatable around a further horizontal shaft in the first support frame between an open and a clamping position; the centering dog having a supporting surface which when rotating from the open to the clamping position, is arranged to perform a translation in a horizontal direction for pushing a top ring of a received mooring buoy radially.

According to an aspect, the present invention relates to a turret mooring system as described above, wherein the locking dog is arranged to rotate around the horizontal shaft to a clamping position after the centering dog has reached the clamping position, the locking dog in the clamping position being arranged for clamping the top ring of the mooring buoy to the turret mooring structure.

According to an aspect, the present invention relates to a turret mooring system as described above, wherein the locking device comprises a second support frame and a hydraulic jack, wherein the second support frame is rotatably connected with the first support frame over the horizontal shaft and the hydraulic jack is connected between a further shaft of the second support frame and an extended arm of the locking dog, wherein the connection of the hydraulic jack and the extended arm of the locking dog comprises a hinge.

According to an aspect, the present invention relates to a turret mooring system as described above, wherein the locking device comprises a releasable connection between the first and the second support frames.

According to an aspect, the present invention relates to a turret mooring system as described above, wherein the releasable connection comprises a backup release jack attached to one of the first and second support frames comprising a release pin and a locking hole attached to the other of the first and second supporting frames, the locking hole arranged for releasably receiving the release pin.

According to an aspect, the present invention relates to a turret mooring system as described above, wherein the hydraulic jack comprises a dedicated hydraulic power unit which is integrated in the locking device.

According to an aspect, the present invention relates to a turret mooring system as described above, wherein a top part of the mooring buoy to be received in the turret mooring structure, comprises a ring portion provided with a first abutment surface and a second abutment surface placed at a distance from and in parallel with the first abutment surface; the locking dog is arranged for engagement with the first abutment surface provided on the ring portion of the mooring buoy; the locking device further comprises an engagement member and the engagement member is arranged for engagement with the second abutment surface of the mooring buoy, wherein a distance between the locking dog in closed position and the engagement member corresponds with the distance between the second abutment surface and the first abutment surface on the mooring buoy.

According to an aspect, the present invention relates to a turret mooring system as described above, wherein the mooring buoy comprises a top part to be received in the turret mooring structure having a ring portion provided with a first abutment surface and a second abutment surface placed at a distance from and in parallel with the first abutment surface, wherein the further structural element is an engagement member; the locking dog being arranged for engagement with the first abutment surface provided on the ring portion of the mooring buoy and the engagement member being arranged for engagement with the second abutment surface of the mooring buoy wherein a distance between the locking dog in closed position and the engagement member corresponds with the distance between the second abutment surface and the first abutment surface on the mooring buoy.

According to an aspect, the present invention relates to a turret mooring system as described above, wherein the locking dog in the clamping position is arranged for clamping the first abutment surface and causes the engagement member to clamp on the second abutment surface.

According to an aspect, the present invention relates to a turret mooring system as described above, wherein the mooring buoy comprises a top part to be received in the turret mooring structure having a ring portion provided with a first abutment surface and a second abutment surface placed at a distance from and in parallel with the first abutment surface, wherein the further structural element is a lower centering dog, the locking dog being arranged for engagement with the first abutment surface provided on the ring portion of the mooring buoy and the lower centering dog being arranged for engagement with the second abutment surface of the mooring buoy wherein a distance between the locking dog in closed position and the lower centering dog corresponds substantially with the distance between the second abutment surface and the first abutment surface on the mooring buoy.

According to an aspect, the present invention relates to a turret mooring system as described above, wherein the locking dog in the clamping position is arranged for clamping the first abutment surface and causes the lower centering dog to clamp on the second abutment surface.

According to an aspect, the present invention relates to a turret mooring system as described above, wherein the lower centering dog is configured to rotate around a horizontal axis from an lower open position for receiving the second abutment surface to an upper clamping position for engaging the second abutment surface, wherein the upper position of the lower centering dog is a blocked position.

According to an aspect, the present invention relates to a turret mooring system arranged for receiving a mooring buoy, the turret mooring system comprising a turret mooring structure, and a buoy locking system for locking the mooring buoy, the mooring buoy comprising at least one buoy connection lug provided on an upper surface portion of the body of the mooring buoy; the connection lug comprising a passage in the lug for receiving a locking body, wherein the buoy locking system comprises at least one locking device, which in a first support frame comprises a rotatable locking dog, the first support frame being connected to the turret mooring structure; the rotatable locking dog having an extended body being arranged for engagement with the connection lug by entering the passage in the lug.

According to an aspect, the present invention relates to a turret mooring system as described above, wherein a locking movement of the locking dog of the at least one locking device is aligned with the orientation of the passage of the corresponding connection lug.

According to an aspect, the present invention relates to a mooring buoy arranged for coupling with a turret mooring system, wherein the mooring buoy comprises at least one buoy connection lug provided on an upper surface portion of the body of the mooring buoy; the lug comprising a passage in the lug for receiving a locking body of a locking device attached to the turret mooring system.

According to an aspect, the present invention relates to a mooring buoy as described above, wherein the connection lug is coupled to a top part of the buoy structure to be received in the turret mooring structure.

According to an aspect, the present invention relates to a mooring buoy as described above, wherein the connection lug is coupled to the buoy structure by a connector plate.

According to an aspect, the present invention relates to a mooring buoy as described above wherein the connector plate comprises a pivot pin.

According to an aspect, the present invention relates to a mooring buoy as described above, wherein the passage has a first width and first height and the extended body of the locking dog has a second width and second height, wherein the second width smaller than the first width, and the second height is smaller than the first height.

According to an aspect, the present invention relates to a mooring buoy as described above, wherein an upper portion of the passage has a curved internal surface with crosswise a first radius of curvature and the extended body of the locking dog has perpendicular to its length of the extended body a curved upper outer surface with a second radius of curvature, wherein the second radius is equal to or smaller than the first radius.

According to an aspect, the present invention relates to a mooring buoy as described above, wherein the connection lug has a curved internal surface in the direction of the opening of the passage, and the extended body has a substantially straight surface along its longitudinal direction.

Further the present invention relates to a vessel comprising a hull and a turret mooring system as described above, wherein the turret mooring system is rotatably suspended from the hull of the vessel.

The present invention relates to a method of mooring a vessel comprising a turret mooring system to a mooring buoy, the turret mooring system being arranged to receive the mooring buoy and the turret mooring system comprising a turret mooring structure being rotatably suspended from the vessel and at least one locking device, which in a first support frame comprises a locking dog and a further structural element, the first support frame being connected to the turret mooring structure;

wherein the further structural element is arranged in the first support frame at a different vertical level than the level of the locking dog, the method comprising:

receiving the mooring buoy into the turret mooring system, contacting the mooring buoy with the locking dog in open position;

lifting the buoy further so as to let the further structural element engage the surface of mooring buoy.

Advantageous embodiments are further defined by the dependent claims.

BRIEF DESCRIPTION OF THE DRAWINGS

Embodiments will now be described, by way of example only, with reference to the accompanying schematic drawings in which corresponding reference symbols indicate corresponding parts, and in which.

DETAILED DESCRIPTION

Figure 1A:
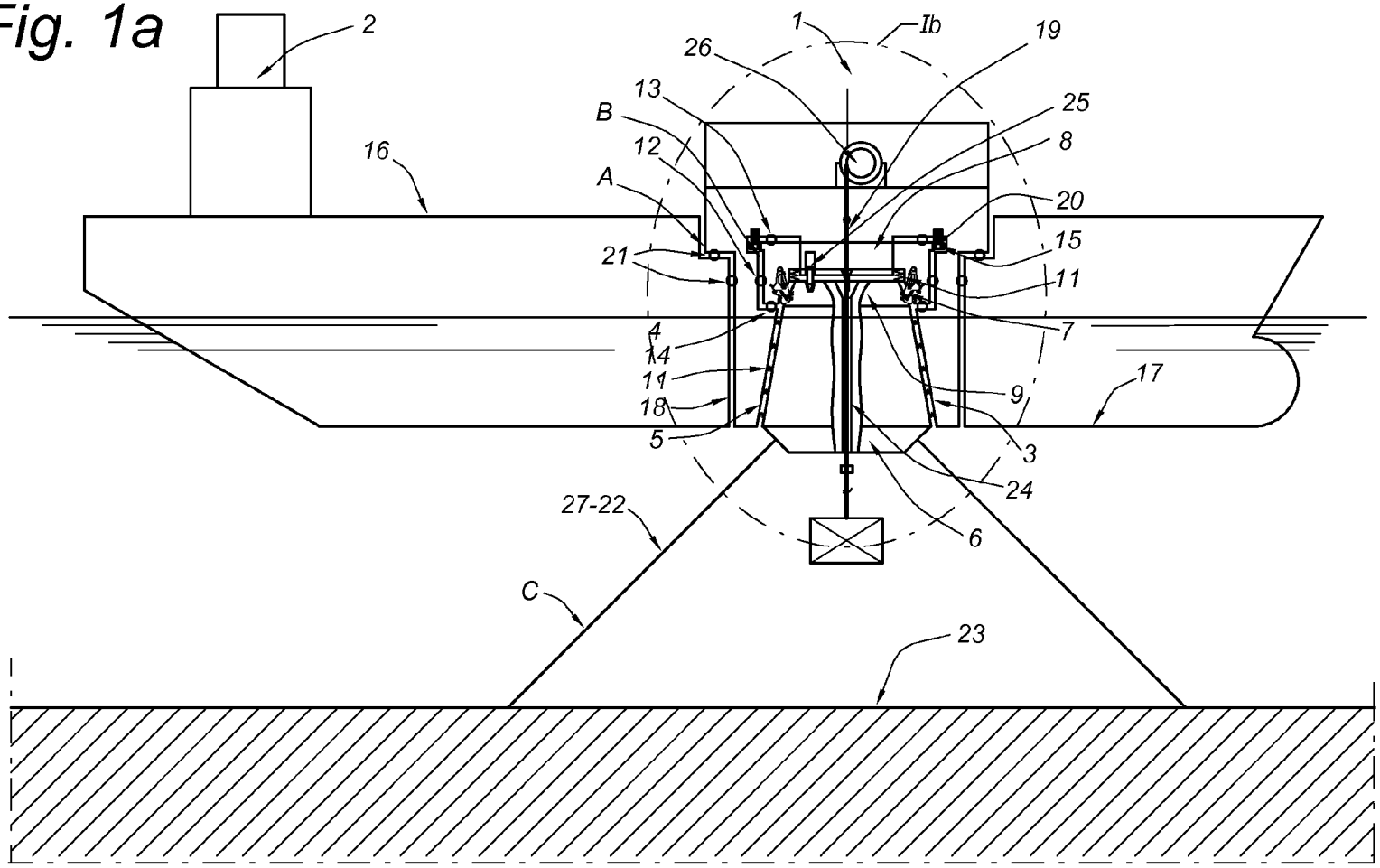
FIG. 1A shows a schematic drawing of a turret mooring system provided on a vessel.

In the following figures, the same reference numerals refer to similar or identical components in each of the figures.

Figure 1B:
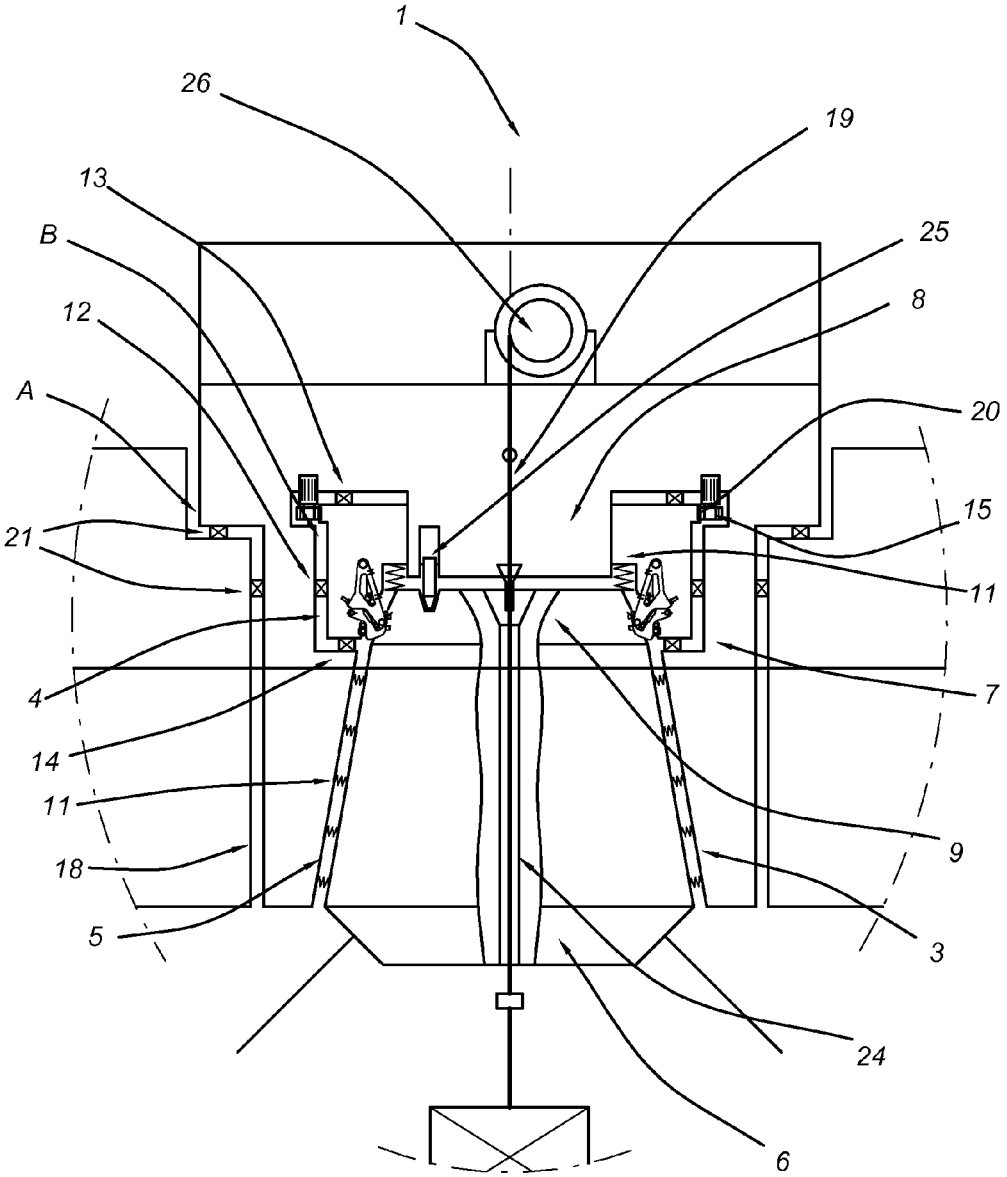
FIG. 1B shows an enlargement of the selected box in FIG. 1A.

FIGS. 1*a*-1*b* show schematic drawings of a turret mooring system 1 provided on a vessel 2, which for example could be a floating production unit (FPU) or floating production storage and offloading (FPSO) unit or floating storage and offloading (FSO) unit. The vessel 2 comprises a hull 16 having near a bottom 17 a moonpool 18. A lifting device 26 is placed on the turret mooring structure 3 comprising a cable 19, shown in FIGS. 1*a*-*b* and 2, that extends through a central shaft 24 provided in the mooring buoy 6. In addition, the vessel 2 comprises a turret mooring system 1, wherein the turret mooring system 1 is rotatably suspended from the hull 16 of the vessel 2. The turret mooring system 1 comprises a turret mooring structure 3 within the moonpool 18.

A turret bearing system 21 connects and aligns the turret mooring structure 3 with respect the vessel 2. The turret mooring system 1 is as a whole rotationally suspended from the vessel 2. The turret mooring system 1 can rotate with respect to the vessel 2 to allow the vessel 2 to weathervane after connection to the mooring buoy 6 or to orientate the turret mooring system 1 with respect to the mooring buoy 6, without the need to reposition the vessel 2.

In addition, the turret mooring system 1 may comprise an intermediate connection member 4. Such an intermediate connection member 4 is arranged to be rotated together with the mooring buoy 6 with respect to the turret mooring structure 3, i.e. after locking the mooring buoy 6 inside the receptacle 5, so that the fluid piping of the turret manifold piping and the buoy manifold piping can be aligned. The intermediate connection member 4 is positioned in between the turret mooring structure 3 and the mooring buoy 6, if present. After disconnecting the mooring buoy 6, the intermediate connection member 4 remains attached to the turret mooring structure 3.

The turret mooring structure 3 comprises a receptacle 5 for receiving a mooring buoy 6. In an alternative embodiment (not shown), the receptacle 5 could be attached directly to the intermediate connection member 4, if present. The mooring buoy 6 carries an anchoring system 27 which may comprise at least 1 anchoring leg 22 that are connected to a seabed 23. The mooring buoy 6 is receivable in the receptacle 5 for coupling with the turret mooring structure 3.

The turret mooring structure 3 comprises a buoy locking system 7, comprising a number of buoy locking devices 10 for locking the mooring buoy 6 inside the receptacle 5. An embodiment of the buoy locking device 10 is described with reference to FIGS. 2-7. The buoy locking system 7 is only shown schematically in FIGS. 1*a-b*.

The turret mooring structure 3 comprises a turret manifold 8 that can be connected, after alignment, to a corresponding buoy manifold 9 to establish a fluid flow path between the turret mooring structure 3 and the mooring buoy 6.

When the mooring buoy 6 enters the receptacle 5, the mooring buoy 6 is pre-centered into the receptacle 5, due to the conical shape and fenders 11 on the inside of the receptacle 5, and due to the pulling tension in the reconnection winch cable of the lifting device 26.

When approaching the locking devices, the top ring of the buoy, lifted-up by a winch, comes into contact vertically with the locking devices that will achieve a final centering of the buoy as will be described in more detail below. When the centering is completed, the locking devices are closed and clamp the top ring of the buoy in the turret mooring structure 3.

After alignment of the fluid piping manifolds and the locking of the turret with regard to the connected buoy 6, a fluid transfer path can be established between the turret and buoy manifold.

Figure 2:
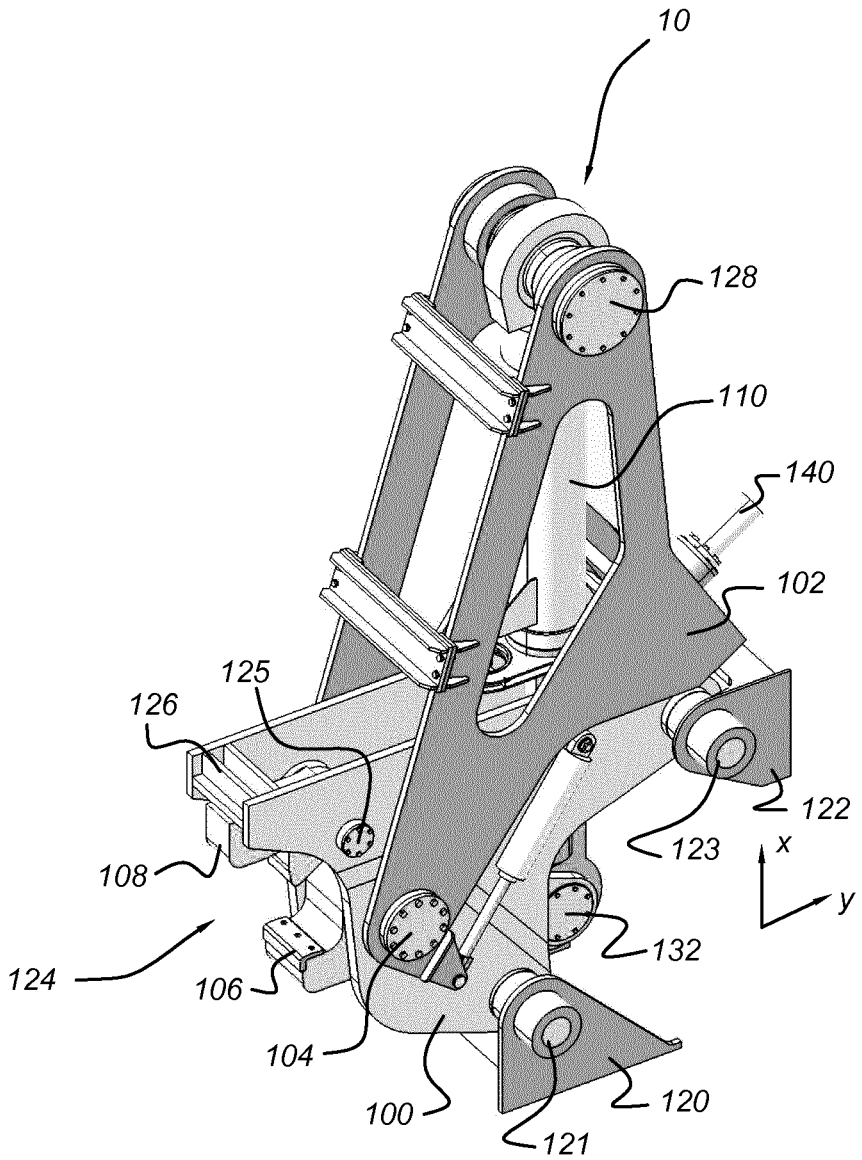
FIG. 2 shows a perspective view of an embodiment of a locking device according to the present invention.

FIG. 2 shows a perspective view of an embodiment of a locking device according to the present invention.

The locking device 10 comprises a first support frame 100 and a second support frame 102. Further the locking device 10 comprises a locking dog 106, a centering dog 108, and a main hydraulic jack 110.

In this embodiment, the first support frame 100 is substantially T-shaped and connected to the turret mooring structure by fixed bottom and side supports 120 and 122 which are located at two substantially perpendicular ends of the T-shaped first support frame. The connection between the first support frame 100 and the fixed supports may be by shafts 121 and 123 respectively.

The second support frame is a substantially oblong frame which has a first end that is rotatably connected to the first support frame by a common shaft 104, which is located in the first support frame at some vertical distance above the fixed bottom support 120.

The locking dog 106 is rotatably connected to the first support frame 100 on the common shaft 104. The centering dog 108 is connected to the first support frame 100 on a dedicated shaft 125 which is located at a vertical distance above the common shaft.

Both the locking dog 106 and the upper centering dog 108 are arranged on a free end 124 of the first support frame 100, i.e., the end of the first support frame that is not connected to the fixed bottom or side supports 120, 122.

A second end of the second support frame 102 is rotatably connected to one end of the main hydraulic jack 110 by means of a shaft 128.

The opposite end of the hydraulic jack 110 is rotatably connected to the locking dog 106 through a hinge 132. The arrangement of the hydraulic jack and the locking dog is described in more detail with reference to FIG. 3.

Additionally, the locking device comprises on the second support frame 102 a backup release (hydraulic) jack 140, which provides a releasable connection between the second support frame and the first support frame at a location adjacent to the fixed side support 122.

One or more of shafts 104, 121, 122, 125, 128 of the locking device 10 are preferably provided with low friction bushes.

Optionally the hydraulic jack on each locking device is operated with a dedicated HPU (Hydraulic Power Unit) with the HPU being integrated within the locking device structure (i.e. not connected to the jack only via a flexible). This has the advantage of having a stand alone locking device as a whole one piece assembly which is complete and only needs to be installed on site.

Figure 3:
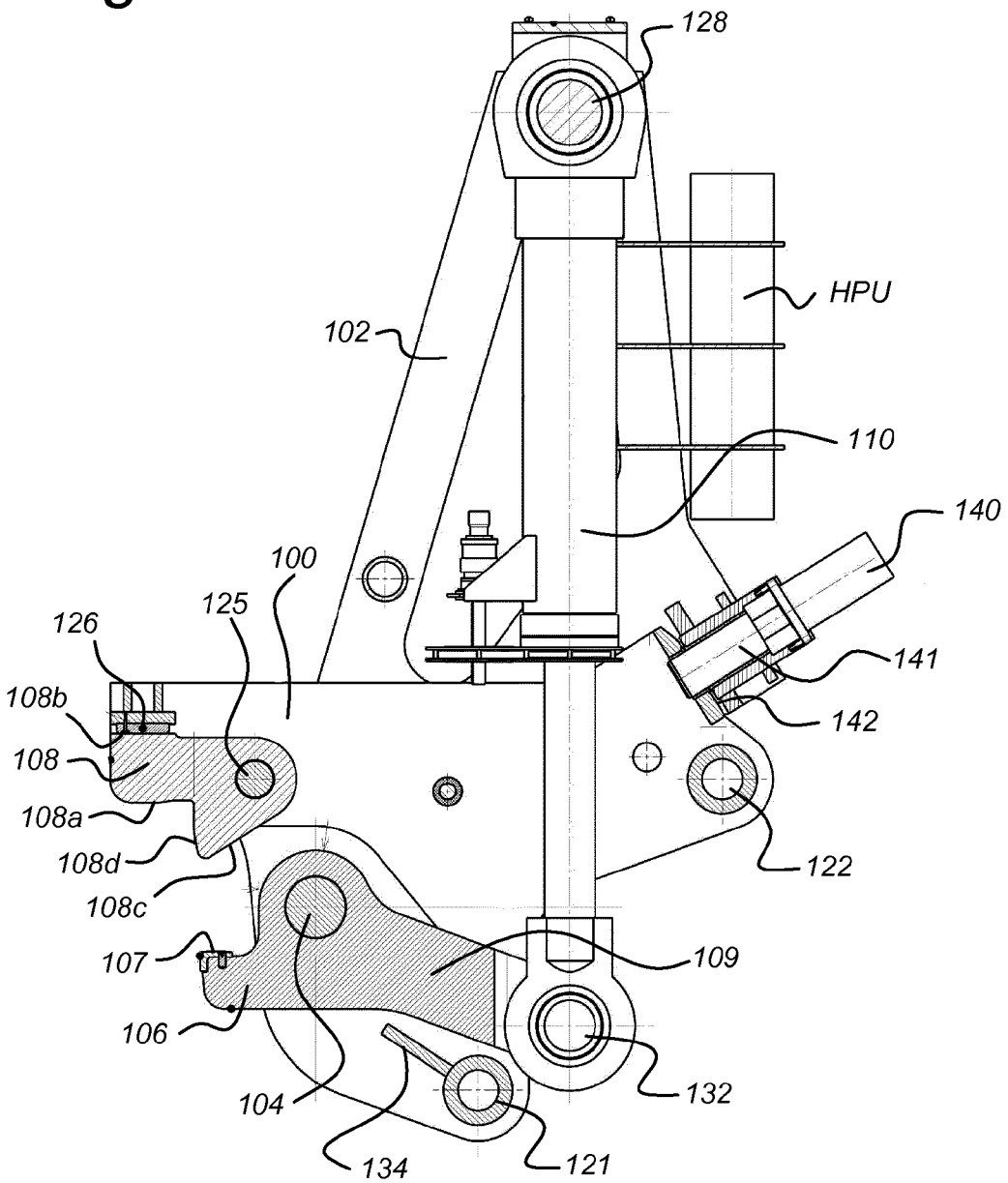
FIG. 3 shows a cross-section of the locking device of FIG. 2.

FIG. 3 shows a cross-section of the locking device of FIG. 2.

The hydraulic jack 110 is rotatably connected to an extension arm 109 of the locking dog 106 through the hinge 132, such that a change of the length of the hydraulic jack causes a rotation of the locking dog 106 around common shaft 104. In FIG. 3, the hydraulic jack is shown in its extended position, with the locking dog 106 in a clamping position of the mooring buoy (not shown).

The centering dog 108 is shown also in a clamping position of the mooring buoy.

A lower edge 108*a* of the centering dog 108, extending over a portion of the length of the body of the centering dog 108 and that is arranged to contact the top ring of the buoy is positioned substantially horizontal. An upper edge 108*b* of the centering dog 108, extending over substantially the full length of the centering dog body is parallel to the lower edge 108*a*. The upper edge 108*b* is arranged to abut a stopper 126 on the first support frame 100 when in the clamping position. In addition to the lower edge 108*a* and upper edge 108*b* portions, the centering dog 108 comprises in a portion of the body close to the shaft 125 an angled edge 108*c* which is arranged under an oblique angle with the upper and lower edges 108*a*, 108*b*. The angled edge 108*c* of the centering dog body is arranged to abut the locking dog 106 when the locking device is in a open position.

In between the lower edge 108*a* and the angled edge 108*c* the centering dog 108 comprises a supporting surface 108*d*, that is substantially perpendicular to the lower edge 108*a*.

The backup release jack 140 is shown in the connected position having a release pin 141 attached to the second support frame and positioned in a locking hole 142 attached to the first support frame to form a releasable connection 141, 142. The backup release jack is arranged as a releasable lock that can break the releasable connection in case of a malfunction of the locking device (or an emergency) during the clamping position. By releasing the releasable connection the second support frame 102 can rotate with respect to the first support frame around the common shaft. Since the rotation axis (common shaft) of the second support frame coincides with the rotation axis 104 of the locking dog 106, the locking dog will rotate accordingly to an open position so as to release the buoy.

Figure 4A:
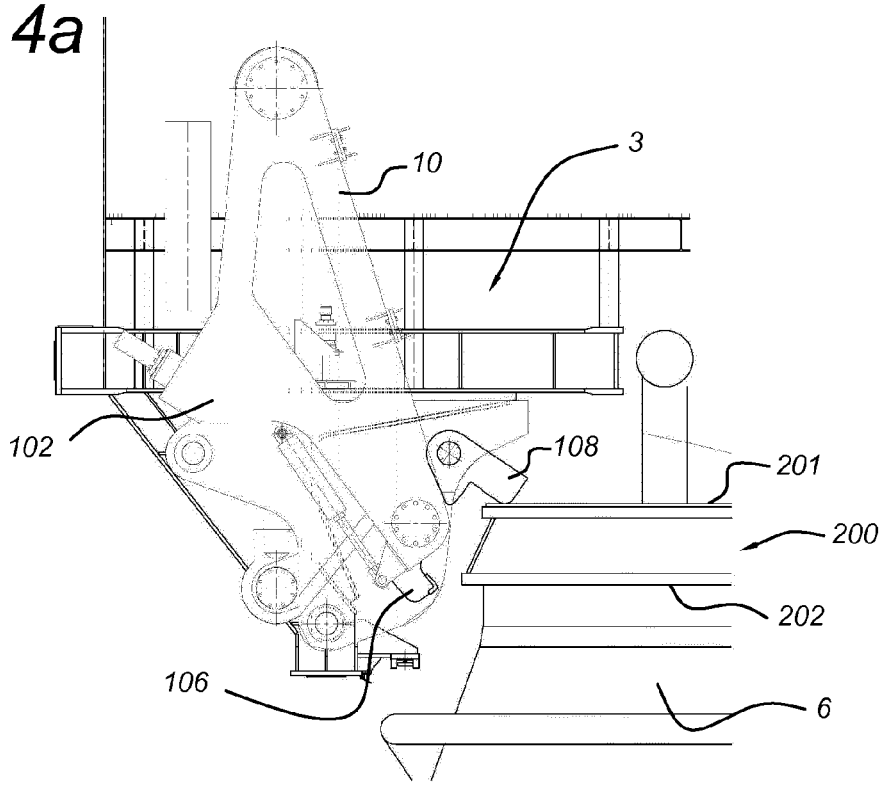
FIG. 4*a* schematically shows the locking device during a first stage of positioning of the buoy into the turret.

In FIG. 4*a* schematically the locking device 10 is shown during a first stage of positioning of the buoy 6 into the turret mooring structure 3.

The mooring buoy 6 comprises a top ring portion 200 which has an upper edge or surface 201 and a lower edge 202.

During this stage the upper surface 201 of the top ring 200 of the buoy is in contact with the lower edge 108*a* of the centering dog 108. The lower edge of the centering dog 108 is in the open position under an oblique angle with respect to the top ring of the buoy. The centering dog starts rotating around the dedicated shaft 125 until it reaches its position wherein the upper edge 108*b* of the centering dog 108 abuts the stopper 126 on the first support frame. At the same time the supporting surface 108*d* is oriented towards the outer circumference of the top ring of the buoy such that during the rotation of the centering dog it pushes radially against the top ring of the buoy to displace the buoy horizontally. Since each of the locking devices on the turret mooring structure performs this rotation and radial push, the buoy will be translated with respect to the turret mooring structure to position centered with respect to the locking devices.

Figure 4B:
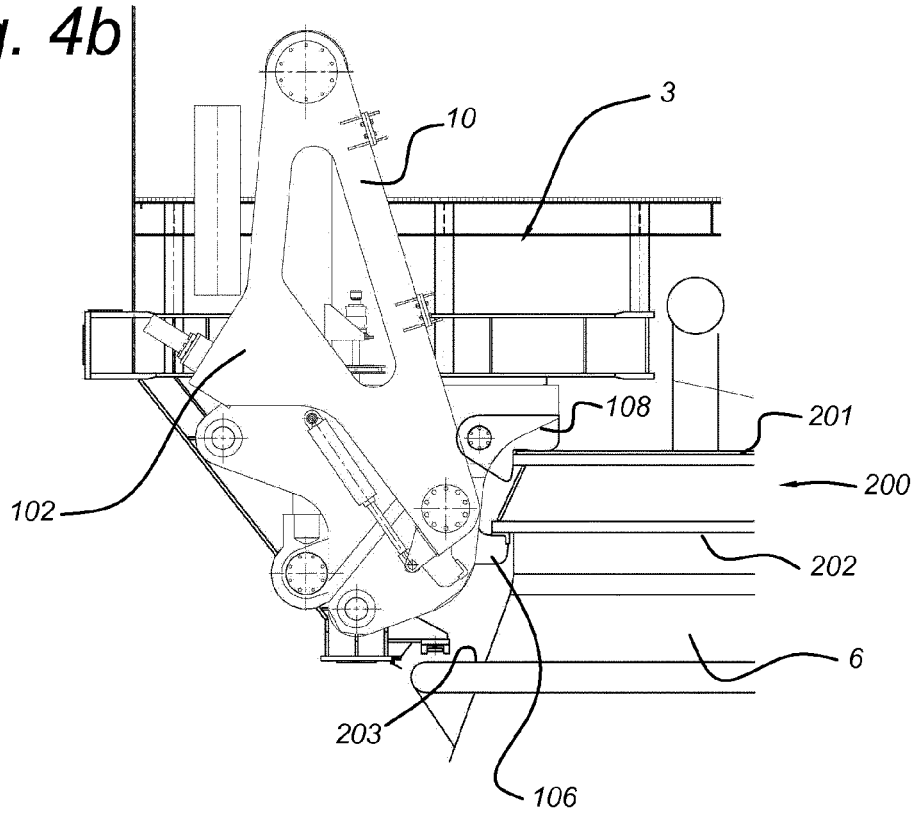
FIG. 4*b* schematically shows the locking device during a second stage of positioning of the buoy into the turret.

FIG. 4*b* schematically shows the locking device during a second stage of positioning of the buoy into the turret. The centering dog 108 now abuts the stopper 126 of the locking device 10. Additionally, the locking dog 108 is in the clapping position.

The locking device is instrumented to monitor the open/clamped status with respect to the status of the mooring buoy, i.e. being either connected or disconnected. In an embodiment, a signaling system comprising a suitable monitoring device e.g. a processing unit and sensors on the locking device and/or the turret mooring system is installed. Thus the present invention relates to a turret mooring system arranged for receiving a mooring buoy 6, the turret mooring system comprising a turret mooring structure 3, and a buoy locking system 7 for locking the mooring buoy 6, wherein the buoy locking system 7 comprises at least one locking device 10, which in a first support frame 100 comprises a locking dog 106 and a further structural element, the first support frame being connected to the turret mooring structure;

wherein the further structural element is arranged in the first support frame at a different vertical level than the level of the locking dog and, the locking dog is rotatable around a horizontal shaft 104 in the first support frame between an open and a clamping position; wherein the further structural element is arranged to engage the surface of the mooring buoy, and wherein the further structural element is an upper centering dog 108 positioned above a level of the locking dog, wherein the centering dog is rotatable around a further horizontal shaft 125 in the first support frame between an open and a clamping position; the centering dog having a supporting surface 108*d* which when rotating from the open to the clamping position, is arranged to perform a translation in a horizontal direction for pushing a top ring of a received mooring buoy radially.

Figure 4C:
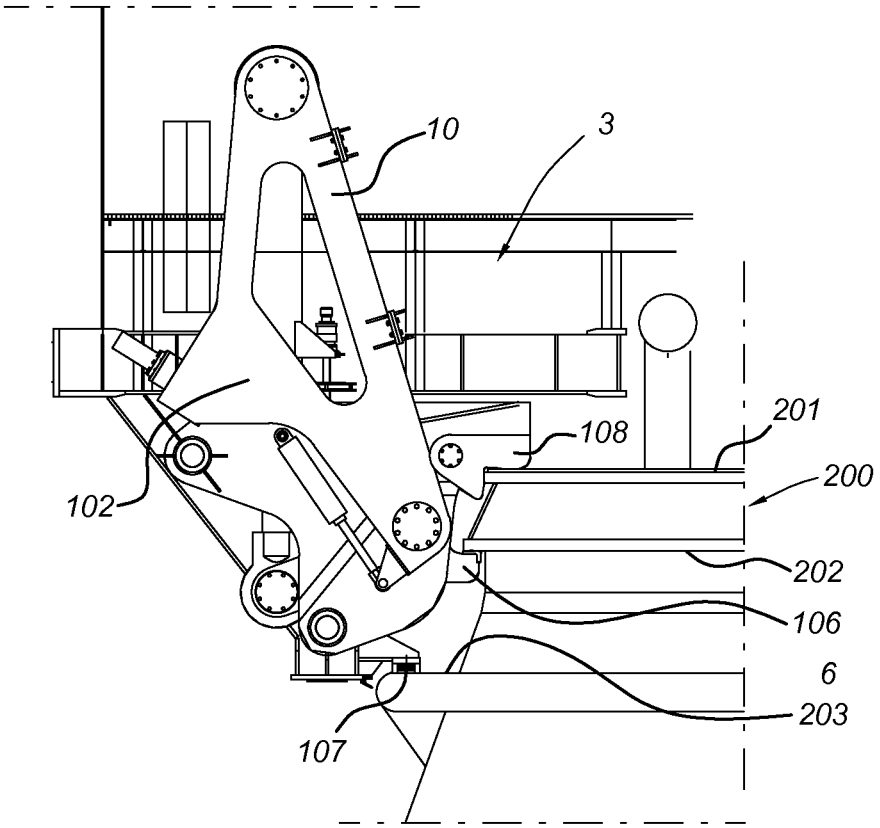
FIG. 4*c* schematically shows the locking device during a third stage of positioning of the buoy into the turret.

FIG. 4*c* schematically shows the locking device during positioning of the buoy into the turret in accordance with an embodiment of the invention.

In this embodiment, the mooring buoy 6 comprises a ring portion 200 at a top part of the buoy that is received in the turret. The ring portion is provided with a first abutment surface 202 and a second abutment surface 203 placed at a distance from and in parallel with the first abutment surface.

The buoy locking system 7 comprises at least one locking device 10 that in a first support frame 100 comprises a rotatable locking dog 106 and an engagement element 107. Within the locking device 10 the locking dog 106 and engagement element 107 are positioned at a vertical distance from each other. In this embodiment, the engagement element 107 is positioned below the locking dog 106.

The rotatable locking dog 106 is arranged for engagement with the first abutment surface 202 provided on the ring portion 200 of the mooring buoy 6. The first abutment surface is collar shaped and positioned in an upper region of the ring portion. Thus a contacting surface of the locking dog can engage the first abutment surface by moving upwards.

The second abutment surface is arranged below the first abutment surface. The engagement member 107 of the locking device can engage with the second abutment surface 203 of the mooring buoy 6, since the upward movement of the locking dog 106 enlarges the distance between the locking dog and the engagement element, thus effectively pulling the second abutment surface up to a contacting surface of the engagement element 107. In this manner the buoy is clamped to the locking device 10. In the clamped position a distance between the contacting surface of the rotatable locking dog 106 and the contacting surface of the engagement member 107 corresponds substantially with the distance between the second abutment surface 203 and the first abutment surface 202 on the mooring buoy.

The contacting surfaces of the locking device may exert some forces on the first and second abutment surfaces to generate a clamping force for holding the mooring buoy in position.

The engagement member may be embodied as a fixed bumper.

In an embodiment, the centering dog 108 may be omitted. Thus the invention relates to a turret mooring system arranged for receiving a mooring buoy 6, the turret mooring system comprising a turret mooring structure 3, and a buoy locking system 7 for locking the mooring buoy 6, wherein the buoy locking system 7 comprises at least one locking device 10, which in a first support frame 100 comprises a locking dog 106 and a further structural element, the first support frame being connected to the turret mooring structure; wherein the further structural element is arranged in the first support frame at a different vertical level than the level of the locking dog and, the locking dog is rotatable around a horizontal shaft 104 in the first support frame between an open and a clamping position; wherein the further structural element is arranged to engage the surface of the mooring buoy and the mooring buoy 6 comprises a top part to be received in the turret mooring structure having a ring portion 200 provided with a first abutment surface 202 and a second abutment surface 203 placed at a distance from and in parallel with the first abutment surface, wherein the further structural element is an engagement member 107, the locking dog 106 being arranged for engagement with the first abutment surface 202 provided on the ring portion 200 of the mooring buoy 6 and the engagement member 107 being arranged for engagement with the second abutment surface 203 of the mooring buoy 6 wherein a distance between the locking dog 106 in closed position and the engagement member 107 corresponds with the distance between the second abutment surface 203 and the first abutment surface 202 on the mooring buoy.

For coupling the mooring buoy to the turret mooring structure using the above arrangement of mooring buoy and locking device, a method comprises the steps of receiving the mooring buoy into the turret mooring system, with the locking dog being set in an open position, leveling the first abutment surface and the locking device with the locking dog in open position;

at the same time, contacting the second abutment surface of the ring portion of mooring buoy and the engagement member;

bringing the locking dog to a clamped position on the first abutment surface so as to lock the ring portion of the mooring buoy to the locking device.

Figure 5A:
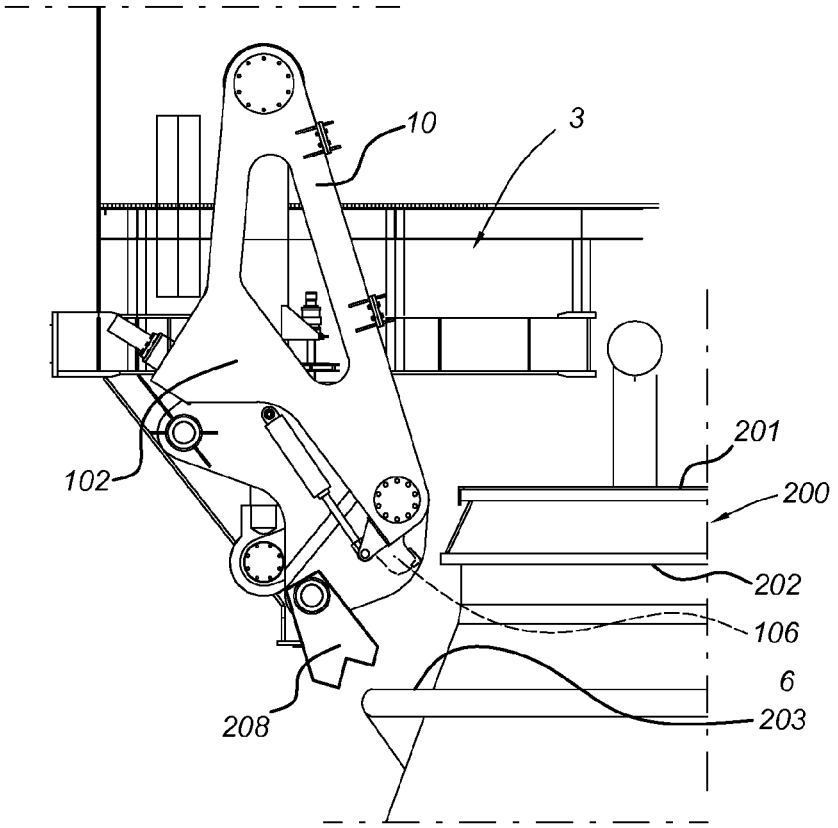
FIGS. 5*a* and 5*b* schematically show a locking device in accordance with an embodiment of the invention.
Figure 5B:
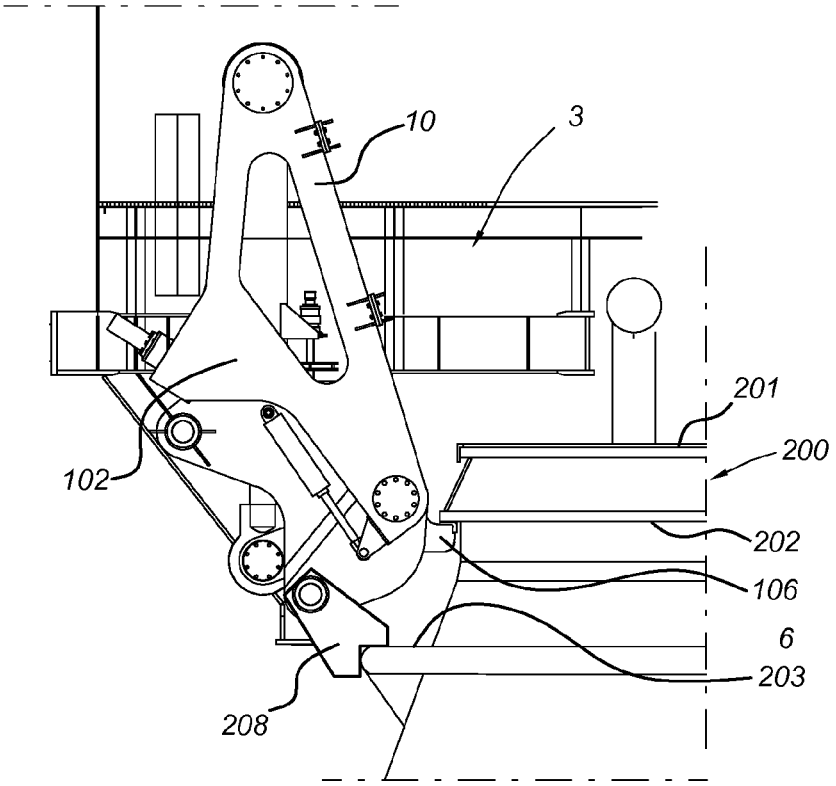

FIGS. 5*a* and 5*b* show a locking device according to an embodiment of the invention.

In this embodiment, the mooring buoy 6 comprises a ring portion 200 at a top part of the buoy that is received in the turret. The ring portion is provided with a first abutment surface 203 and a second abutment surface 204 placed at a distance from and in parallel with the first abutment surface.

The buoy locking system 7 comprises at least one locking device 10 that in a first support frame 100 comprises a rotatable locking dog 106 and a centering dog element 208. Within the locking device 10 the locking dog 106 and a lower centering dog 208 are positioned at a vertical distance from each other. In this embodiment, the lower centering dog 208 is positioned below the locking dog 106. The lower centering dog 208 is arranged for rotation around a horizontal axis between a lower position 209 and an upper position 210. In the upper position 210 the lower centering dog 208 is configured to be blocked from further upward rotation.

The rotatable locking dog 106 is arranged for engagement with the first abutment surface 202 provided on the ring portion 200 of the mooring buoy 6. The first abutment surface is collar shaped and positioned in an upper region of the ring portion. Thus a contacting surface of the locking dog 106 can engage the first abutment surface by moving upwards.

The second abutment surface is arranged below the first abutment surface for engaging the second abutment surface 203.

Before contacting the second abutment surface 203 of the buoy 6, the lower centering dog 208 is in an open position 209, configured to contact and engage with the second abutment surface and after contact to rotate upward with the upward moving buoy 6.

During the upward movement of the second abutment surface 203, the lower centering dog 208 rotates upwards, until the upper position 210 is reached and further rotation is blocked. In that upper position the upward movement of the buoy surface is stopped.

The upward movement of the locking dog 106 may enlarge the distance between the locking dog and the lower centering dog 208, thus effectively pulling the second abutment surface upto a contacting surface of the lower centering dog 208. In this manner the buoy is clamped to the locking device 10.

In the clamped position a distance between the contacting surface of the rotatable locking dog 106 and the contacting surface of the lower centering dog 208 corresponds substantially with the distance between the second abutment surface 203 and the first abutment surface 202 on the mooring buoy.

The contacting surfaces of the locking device may exert some forces on the first and second abutment surfaces 202, 203 to generate a clamping force for holding the mooring buoy 6 in position.

Thus the invention relates to a turret mooring system arranged for receiving a mooring buoy 6, the turret mooring system comprising a turret mooring structure 3, and a buoy locking system 7 for locking the mooring buoy 6, wherein the buoy locking system 7 comprises at least one locking device 10, which in a first support frame 100 comprises a locking dog 106 and a further structural element, the first support frame being connected to the turret mooring structure; wherein the further structural element is arranged in the first support frame at a different vertical level than the level of the locking dog and, the locking dog is rotatable around a horizontal shaft 104 in the first support frame between an open and a clamping position; wherein the further structural element is arranged to engage the surface of the mooring buoy, and wherein the mooring buoy 6 comprises a top part to be received in the turret mooring structure having a ring portion 200 provided with a first abutment surface 202 and a second abutment surface 203 placed at a distance from and in parallel with the first abutment surface, wherein the further structural element is a lower centering dog 208; the locking dog 106 being arranged for engagement with the first abutment surface 202 provided on the ring portion 200 of the mooring buoy 6 and the lower centering dog 208 being arranged for engagement with the second abutment surface 203 of the mooring buoy 6 wherein a distance between the locking dog 106 in closed position and the lower centering dog 208 corresponds substantially with the distance between the second abutment surface 203 and the first abutment surface 202 on the mooring buoy.

For coupling the mooring buoy to the turret mooring structure using the above arrangement of mooring buoy and locking device, a method comprises the steps of receiving the mooring buoy into the turret mooring system, with the locking dog and the lower centering dog being set in an open position, leveling the first abutment surface and the locking device with the locking dog in open position;

bringing the locking dog to a clamped position on the first abutment surface thus upward moving the first abutment surface of the mooring buoy relative to the locking device.

at the same time, contacting the second abutment surface of the ring portion of mooring buoy with a contacting surface of the lower centering dog;

during upward moving, rotating the lower centering dog to an upper blocked position, thus effectively locking the buoy with the first abutment surface above the locking dog at the clamped position of the locking dog on and the second abutment surface below the surface of the lower centering dog in the upper blocked position.

Figure 6:
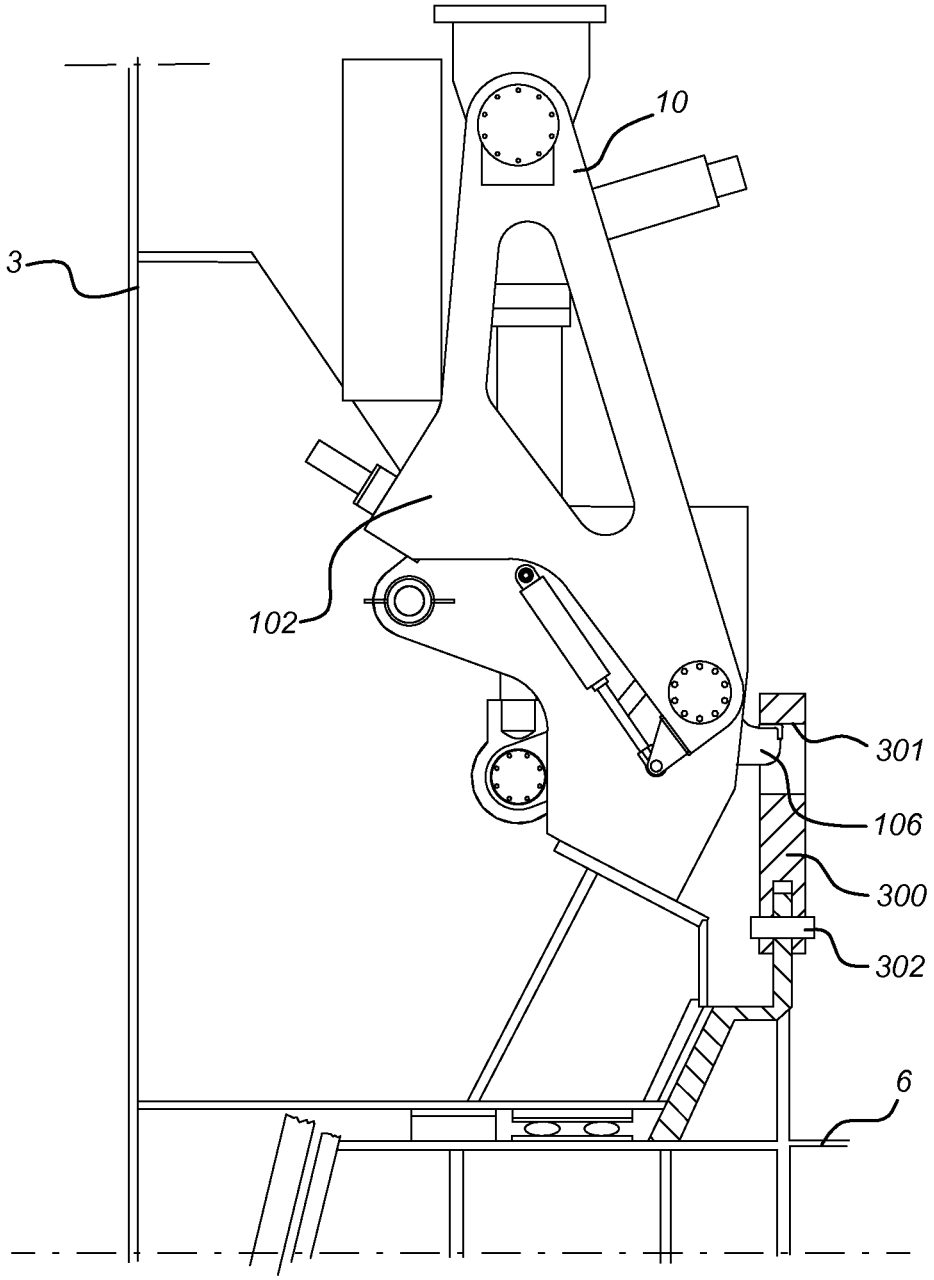
FIG. 6 schematically shows a locking device according to an embodiment of the invention.

FIG. 6 schematically shows a locking device in accordance with an embodiment of the invention.

In this embodiment, the mooring buoy 6 comprises at least one buoy connection lug 300 provided on an upper surface portion of the body of the mooring buoy. The connection lug is provided with a passage 301 in the lug for receiving a locking body.

To this end, the buoy locking system 7 comprises at least one locking device 10, which in the first support frame 100 that is connected to the turret mooring structure, and which comprises a rotatable locking dog 106.

The rotatable locking dog 106 has an extended body being arranged for engagement with the connection lug 300 by entering the passage 301 in the lug. The extended body can be moved from vertical position to a horizontal position in which the extended body is positioned in the passage in the lug to couple the mooring buoy to the turret mooring structure.

The extended body may exert some upward force on the connection lug 300 to generate a clamping force for holding the mooring buoy 6 in position in the turret mooring structure.

FIGS. 7*a*-7*d* show detailed views of the locking device during the locked phase of the mooring buoy and the turret.

Figure 7A:
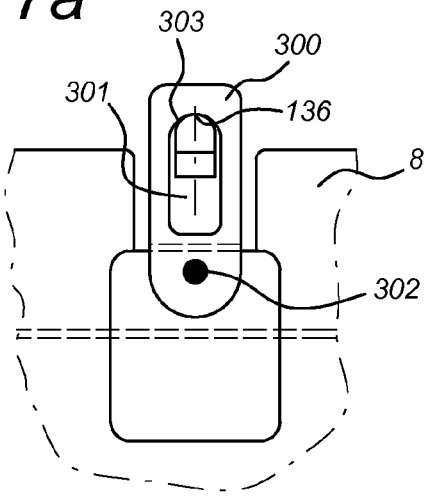
FIGS. 7*a*-7*d* shows detailed views of the locking device during the locked phase of the buoy and the turret.

FIG. 7*a* shows a schematic side view of the connection lug 300 during the locked phase of the mooring buoy 6 and the turret. The connection lug 300 is shown in a viewing direction parallel to the passage 301. The connection lug is attached to the upper part of the mooring buoy.

In an embodiment, the connection lug 300 is connected to the mooring buoy 6 by a coupling pin 302, which functions as a pivot, allowing the connection lug to pivot around the coupling pin.

In the upper part of the passage 301 the extended body of the locking dog 106 is shown in cross-section. The inner surface 303 of the passage 301 has a curved surface in its upper part. Similarly, the upper part 136 of the extended body that in the clamped position is in contact with the inner surface of the connection lug, has a rounded surface curved around the longitudinal axis of the extended body. In this manner it is achieved that while the inner surface 303 of the lug 300 and the upper surface 136 of the extended body of the locking dog 106 are in contact a rotation relative to each other is possible. Such a rotation a is shown in FIG. 7*b*. Advantageously, this rotation can provide compensation for a torsional misalignment of the mooring buoy. In this situation the connection lug 300 may also rotate around the coupling pivot 302 on the mooring buoy.

Figure 7C:
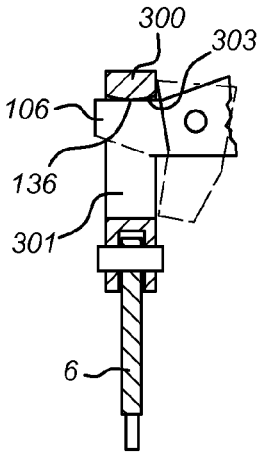
Figure 7B:
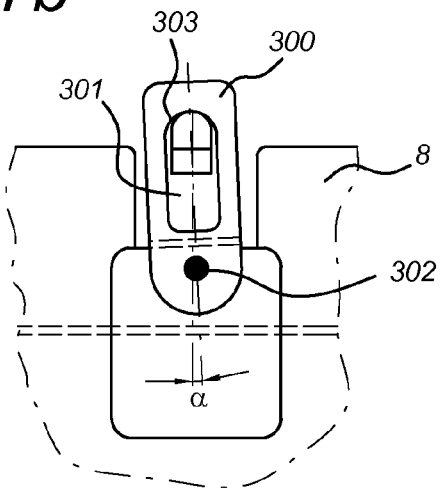
Figure 7D:
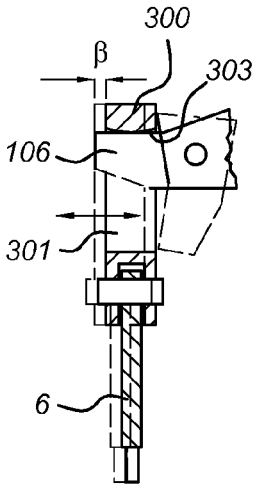

FIG. 7*c* shows a cross-sectional view across the extended body of the locking dog 106 during the locked phase of the mooring buoy and the turret. The solid outline shows the extended body in horizontal coupled position. The dashed outline shows the extended body in vertical opened position.

In the longitudinal direction, the upper surface 136 of the extended body is substantially straight. When coupled with the extended body in horizontal position, the inner surface 303 of the passage 301 of the lug 300 adjacent to the upper surface 136 of the extended body is preferably rounded in the same direction as the length of the extended body. In this manner the connection lug 300 can move relative to the extended body of the locking dog 106, allowing compensation of a radial motion β of the mooring buoy relative to the locking device. See FIG. 7*d*.

In an embodiment, the inner surface of the passage of the lug is double curved to allow rotation due to torsional misalignment and/or radial motion.

For coupling the mooring buoy to the turret mooring structure using the above connection lug and locking dog arrangement, a method comprises the steps of receiving the mooring buoy into the turret mooring system with the locking device in an open position;

positioning the mooring buoy relative to the locking device to align the locking device with the connection lug;

moving the locking dog from the open position to a closed position for engagement with the connection lug by entering of the locking dog into the passage so as to couple the connection lug of the mooring buoy to the locking device.

The descriptions above are intended to be illustrative, not limiting. It will be apparent to one skilled in the art that modifications may be made to the invention as described above without departing from the scope of the claims set out below.

LIST OF PARTS

1. Turret mooring system
2. Vessel
3. Turret mooring structure
4. Intermediate connection member
5. Receptacle
6. Mooring buoy
7. Buoy locking system
8. Turret manifold
9. Buoy manifold
10. Locking device
11. Fenders
12. Radial bearing
13. Upper axial bearing
14. Lower axial bearing
15. Driving member
16. Hull
17. Bottom of hull
18. Moon pool
19. Cable
20. Annular ring
21. Turret bearing system
22. Anchoring legs
23. Seabed
100. First support frame
102. Second support frame
104. Common shaft
106. Locking dog
107. Engagement element
108. Centering dog
108*a*. Lower edge
108*b*. Upper edge
108*c*. Angled edge
108*d*. Supporting surface
110. Main hydraulic jack
120, 122. Fixed bottom and side supports
121, 123, 125, 128. Shaft
126. Stopper
132. Hinge
140. Backup release jack
141. Release pin
142. Locking hole
200. Top ring portion
201. Upper edge or surface
202. Lower edge, First abutment surface
203. Second abutment surface
205. Connection lug
206. Passage
207. Locking dog body
208. Lower centering dog

The invention claimed is:

1. Turret mooring system arranged for receiving a mooring buoy (6), the turret mooring system comprising:

a turret mooring structure (3) with a receptacle for receiving the mooring buoy (6), and a buoy locking system (7) for locking the mooring buoy (6), wherein the buoy locking system (7) comprises at least one locking device (10) comprised of a first support frame (100), a locking dog (106), and a centering dog, the first support frame being connected to the turret mooring structure;

wherein the centering dog is arranged in the first support frame at a different vertical level than a level of the locking dog, the locking dog being rotatable around a horizontal shaft (104) in the first support frame between an open position and a closed position;

wherein the centering dog is arranged to engage the surface of the mooring buoy;

wherein the centering dog is an upper centering dog (108) positioned above the level of the locking dog, wherein the centering dog is rotatable around a second horizontal shaft (125) in the first support frame between an open position and a clamping position, the upper centering dog having a supporting surface (108*d*) which when rotating from the open position to the clamping position, is arranged to perform a translation in a horizontal direction for pushing radially on a top ring of a received mooring buoy.

2. Turret mooring system according to claim 1, wherein the locking dog is arranged to rotate around the first horizontal shaft (104) to a clamping position after the centering dog has reached the clamping position, the locking dog in the clamping position being arranged for clamping the top ring of the mooring buoy to the turret mooring structure.

3. Turret mooring system according to claim 1, wherein the locking device (10) comprises a second support frame and a hydraulic jack, wherein the second support frame is rotatably connected with the first support frame over the first horizontal shaft (104) and the hydraulic jack is connected between a third shaft (128) of the second support frame and an extended arm of the locking dog, wherein a connection of the hydraulic jack and the extended arm of the locking dog comprises a hinge (132).

4. Turret mooring system according to claim 3, wherein the hydraulic jack comprises a dedicated hydraulic power unit which is integrated in the locking device.

5. Turret mooring system according to claim 3, wherein the locking device comprises a releasable connection between the first and the second support frames.

6. Turret mooring system according to claim 5, wherein the releasable connection comprises a backup release jack attached to one of the first and second support frames comprising a release pin and a locking hole attached to the other of the first and second supporting frames, the locking hole arranged for releasably receiving the release pin.

7. Turret mooring system according to claim 1, wherein a top part of the mooring buoy (6) that is received in the turret mooring structure, comprises a ring portion (200) provided with a first abutment surface (202) and a second abutment surface (203) placed at a distance from and in parallel with the first abutment surface;

wherein the locking dog (106) is arranged for engagement with the first abutment surface (202) provided on the ring portion (200) of the mooring buoy (6);

wherein the locking device further comprises an engagement member (107) and the engagement member (107) is arranged for engagement with the second abutment surface (203) of the mooring buoy (6), and wherein a distance between the locking dog (106) in closed position and the engagement member (107) corresponds with the distance between the second abutment surface (203) and the first abutment surface (202) on the mooring buoy.

8. Turret mooring system according to claim 7, wherein the locking dog in the clamping position is arranged for clamping the first abutment surface and causes the engagement member to clamp on the second abutment surface.

9. Turret mooring system according to claim 1, wherein a top part of the mooring buoy (6) that is received in the turret mooring structure comprises a ring portion (200) provided with a first abutment surface (202) and a second abutment surface (203) placed at a distance from and in parallel with the first abutment surface, wherein the locking device includes an engagement member (107), the locking dog (106) being arranged for engagement with the first abutment surface (202) provided on the ring portion (200) of the mooring buoy (6) and the engagement member (107) being arranged for engagement with the second abutment surface (203) of the mooring buoy (6), and wherein a distance between the locking dog (106) in closed position and the engagement member (107) corresponds with the distance between the second abutment surface (203) and the first abutment surface (202) on the mooring buoy.

10. Turret mooring system according to claim 1, wherein a top part of the mooring buoy (6) that is received in the turret mooring structure comprises a ring portion (200) provided with a first abutment surface (202) and a second abutment surface (203) placed at a distance from and in parallel with the first abutment surface, wherein the centering dog is a lower centering dog (208), the locking dog (106) being arranged for engagement with the first abutment surface (202) provided on the ring portion (200) of the mooring buoy (6) and the lower centering dog (208) being arranged for engagement with the second abutment surface (203) of the mooring buoy (6), and wherein a distance between the locking dog (106) in closed position and the lower centering dog (208) corresponds substantially with the distance between the second abutment surface (203) and the first abutment surface (202) on the mooring buoy.

11. Turret mooring system according to claim 10, wherein the locking dog in the clamping position is arranged for clamping the first abutment surface and causes the lower centering dog to clamp on the second abutment surface.

12. Turret mooring system according to claim 10, wherein the lower centering dog (208) is configured to rotate around a horizontal axis from a lower open position for receiving the second abutment surface to an upper clamping position for engaging the second abutment surface, and wherein the upper position of the lower centering dog is configured to be blocked from upward rotation.

13. Turret mooring system according to claim 1, wherein the turret mooring system (1) is rotatably suspended from a hull (16) of a vessel (2).

14. Method of mooring a vessel comprising a turret mooring system (1) to a mooring buoy (6), the turret mooring system (1) being arranged to receive the mooring buoy (6) and the turret mooring system (1) comprising a turret mooring structure (3) being rotatably suspended from the vessel (2) and at least one locking device (10), which in a first support frame (100) comprises a locking dog (106) and a centering dog, the first support frame being connected to the turret mooring structure; wherein the centering dog is arranged in the first support frame at a different vertical level than a level of the locking dog, the method comprising:

receiving the mooring buoy (6) into the turret mooring system (1);

contacting the mooring buoy with the locking dog in open position; and lifting the mooring buoy further so as to let the centering dog engage the surface of mooring buoy, wherein the locking dog is rotatable around a horizontal shaft (104) in the first support frame between an open and a closed position; and wherein the centering dog is an upper centering dog (108) having a supporting surface (**108*d*), and rotatable around a further horizontal shaft (125**) in the first support frame between an open and a clamped position; the engaging of the centering dog with the surface of the mooring buoy comprises:

contacting a top ring of the mooring buoy with the centering dog and rotating the upper centering dog; and displacing the mooring buoy horizontally with respect to the locking device by a rotation of a supporting surface of the upper centering dog pushing radially against the top ring of the mooring buoy.

15. Method of mooring a vessel comprising a turret mooring system (1) to a mooring buoy (6), according to claim 14, wherein the centering dog is an engagement member (107), and wherein the mooring buoy (6) comprises a top part to be received in the turret mooring structure and having a ring portion (200) provided with a first abutment surface (202) for engagement with the locking dog (106) and a second abutment surface (203) for engagement with the engagement member (107); the method comprising:

receiving the mooring buoy (6) into the turret mooring system (1), with the locking dog (106) in an open position, leveling the first abutment surface (202) and the locking device (10) with the locking dog (106) in open position; and at the same time, contacting the second abutment surface (203) of the ring portion (200) of mooring buoy (6) and the engagement member (107); and bringing the locking dog (106) to a closed position on the first abutment surface thus locking the ring portion (200) of the mooring buoy (6) to the locking device (10), with a distance between the locking dog (106) in closed position and the engagement member (107) corresponding with the distance between the second abutment surface (203) and the first abutment surface (202) on the mooring buoy.

16. Method of mooring a vessel comprising a turret mooring system (1) to a mooring buoy (6), the turret mooring system (1) being arranged to receive the mooring buoy (6) and the turret mooring system (1) comprising a turret mooring structure (3) being rotatably suspended from the vessel (2) and at least one locking device (10), which in a first support frame (100) comprises a locking dog (106) and a centering dog, the first support frame being connected to the turret mooring structure; wherein the centering dog is arranged in the first support frame at a different vertical level than a level of the locking dog, the method comprising:

receiving the mooring buoy (6) into the turret mooring system (1);

contacting the mooring buoy with the locking dog in open position; and lifting the mooring buoy further so as to let the centering dog engage the surface of mooring buoy, wherein the locking dog is rotatable around a horizontal shaft (104) in the first support frame between an open and a closed position; and wherein the centering dog is an upper centering dog (108) having a supporting surface (108*d*), and rotatable around a further horizontal shaft (125) in the first support frame between an open and a clamped position; the engaging of the centering dog with the surface of the mooring buoy comprises:

contacting a top ring of the mooring buoy with the centering dog and rotating the upper centering dog; and displacing the mooring buoy horizontally with respect to the locking device by a rotation of a supporting surface of the upper centering dog pushing radially against the top ring of the mooring buoy.

17. Method of mooring a vessel comprising a turret mooring system (1) to a mooring buoy (6) according to claim 16, comprising locking of the top ring of the mooring buoy by the locking dog.

18. Method of mooring a vessel comprising a turret mooring system (1) to a mooring buoy (6) according to claim 16, wherein the locking of the top ring is preceded by displacing the mooring buoy horizontally.

19. Method according to claim 16, wherein the at least one locking device (10) comprises in the first support frame (100) an engagement member (107), and the top ring of the mooring buoy is provided with a ring portion (200) having a first abutment surface (202) and with a second abutment surface (203) placed at a distance from and in parallel with the first abutment surface, wherein the first abutment surface (202) is arranged for engagement with the locking device (10) and the second abutment surface (203) is arranged for engagement with the engagement member (107); the method further comprising:

contacting the second abutment surface (203) of the ring portion (200) of the mooring buoy (6) and the engagement member (107);

bringing the locking dog (6) to the closed position on the first abutment surface so as to lock the ring portion (200) of the mooring buoy (6) to the locking device (10), with a distance between the locking dog (106) in closed position and the engagement member (107) corresponding with the distance between the second abutment surface (203) and the first abutment surface (202) on the mooring buoy.

20. Method according to claim 19, wherein the step of bringing the locking dog in the closed position for clamping the first abutment surface, displaces the second abutment surface relative to the engagement member causing a clamping force between the engagement member and the second abutment surface.

21. Method of mooring a vessel comprising a turret mooring system (1) to a mooring buoy (6), the turret mooring system (1) being arranged to receive the mooring buoy (6) and the turret mooring system (1) comprising a turret mooring structure (3) being rotatably suspended from the vessel (2) and at least one locking device (10), which in a first support frame (100) comprises a locking dog (106) and a centering dog, the first support frame being connected to the turret mooring structure; wherein the centering dog is arranged in the first support frame at a different vertical level than a level of the locking dog, the method comprising:

receiving the mooring buoy (6) into the turret mooring system (1);

contacting the mooring buoy with the locking dog in open position; and lifting the mooring buoy further so as to let the centering dog engage the surface of mooring buoy, wherein the centering dog is a lower centering dog, the lower centering dog (208) being arranged for engagement with the second abutment surface (203) of the mooring buoy (6) wherein a distance between the locking dog (106) in closed position and the lower centering dog (208) corresponds with a distance between the second abutment surface (203) and the first abutment surface (202) on the mooring buoy; the method comprising:

receiving the mooring buoy into the turret mooring system, with the locking dog and the lower centering dog being set in an open position, leveling the first abutment surface and the locking device with the locking dog in open position;

bringing the locking dog to a closed position on the first abutment surface thus upward contacting the first abutment surface of the mooring buoy relative to the locking device, at the same time, contacting the second abutment surface of the ring portion of mooring buoy with a contacting surface of the lower centering dog; and during upward contacting, rotating the lower centering dog to an upper blocked position, thus effectively locking the mooring buoy with the first abutment surface above the locking dog at the closed position of the locking dog and with the second abutment surface below the surface of the lower centering dog in the upper blocked position.

* * * * *